US008757134B2

(12) United States Patent
Kim et al.

(10) Patent No.: US 8,757,134 B2
(45) Date of Patent: Jun. 24, 2014

(54) WAFER DICING BLADE AND WAFER DICING APPARATUS INCLUDING THE SAME

(75) Inventors: Young-Ja Kim, Asan-si (KR); Junyoung Ko, Cheonan-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 295 days.

(21) Appl. No.: 13/177,167

(22) Filed: Jul. 6, 2011

(65) Prior Publication Data

US 2012/0009026 A1 Jan. 12, 2012

(30) Foreign Application Priority Data

Jul. 7, 2010 (KR) ..... 10-2010-0065538

(51) Int. Cl.
*B28D 1/12* (2006.01)

(52) U.S. Cl.
USPC ..... 125/15; 125/11.01

(58) Field of Classification Search
CPC ..... B28D 1/121; B28D 5/022; B28D 5/011; B28D 5/0052
USPC ..... 125/15, 11.01; 451/542, 541, 546, 547; 83/62, 62.1, 58
See application file for complete search history.

(56) References Cited

U.S. PATENT DOCUMENTS

| | | | | | |
|---|---|---|---|---|---|
| 1,046,737 | A | * | 12/1912 | Conklin | 407/45 |
| 3,016,661 | A | * | 1/1962 | Nidlsen | 451/541 |
| 3,122,030 | A | * | 2/1964 | Metzger | 76/112 |
| 3,146,561 | A | * | 9/1964 | Lindblad | 451/542 |
| 3,271,911 | A | * | 9/1966 | McKenna | 451/541 |
| 3,329,138 | A | * | 7/1967 | Lupardo | 125/15 |
| 3,553,905 | A | * | 1/1971 | Lemelson | 451/541 |
| 4,180,048 | A | * | 12/1979 | Regan | 125/15 |
| 4,787,362 | A | * | 11/1988 | Boucher et al. | 125/15 |
| 5,495,844 | A | * | 3/1996 | Kitajima et al. | 125/13.01 |
| 5,702,492 | A | * | 12/1997 | Elsbree | 51/307 |
| 5,871,005 | A | * | 2/1999 | Sueta | 125/15 |
| 6,024,635 | A | * | 2/2000 | Cruickshank et al. | 451/541 |
| 6,033,295 | A | * | 3/2000 | Fisher et al. | 451/540 |
| 6,855,039 | B2 | * | 2/2005 | Vidmore | 451/342 |
| 7,557,016 | B2 | * | 7/2009 | Kadoi | 438/460 |
| 2003/0136394 | A1 | * | 7/2003 | Blair et al. | 125/13.01 |
| 2007/0175466 | A1 | * | 8/2007 | Kadoi | 125/13.01 |
| 2008/0202488 | A1 | * | 8/2008 | Kim et al. | 125/15 |

FOREIGN PATENT DOCUMENTS

| | | | | |
|---|---|---|---|---|
| DE | 3300796 | A1 * | 10/1983 | B24D 5/12 |
| JP | 05-004160 | A | 1/1993 | |
| JP | 11-010549 | A | 1/1999 | |
| KR | 10-0231087 | B1 | 8/1999 | |

* cited by examiner

*Primary Examiner* — George Nguyen
(74) *Attorney, Agent, or Firm* — Lee & Morse, P.C.

(57) ABSTRACT

A wafer dicing blade includes a cutting part including a protrusion, the protrusion having a uniform region with a substantially uniform width, and a support covering at least one sidewall of the cutting part, the protrusion of the cutting part extending beyond an edge of the support.

19 Claims, 9 Drawing Sheets

WAFER DICING BLADE AND WAFER DICING APPARATUS INCLUDING THE SAME

CROSS-REFERENCE TO RELATED APPLICATIONS

This U.S. non-provisional patent application claims priority under 35 U.S.C. §119 to Korean Patent Application No. 10-2010-0065538, filed on Jul. 7, 2010, in the Korean Intellectual Property Office, and entitled: "Wafer Dicing Blade and Wafer Dicing Apparatus Comprising the Same," the entirety of which is hereby incorporated by reference.

BACKGROUND

1. Field

The present inventive concept herein relates to semiconductor apparatuses used to manufacture semiconductor devices and, more particularly, to a wafer dicing blade and a wafer dicing apparatus including the same.

2. Description of the Related Art

Among semiconductor processes, a semiconductor assembly process may include separating semiconductor chips formed on a wafer and packaging the separated semiconductor chips. Specifically, a plurality of semiconductor chips may be formed on a single wafer. The semiconductor chips may be separated from one another by a cutting process performed along scribe lanes formed between semiconductor chips. The separated semiconductor chips may be assembled in a semiconductor package. Thus, the semiconductor chip may be protected from an external impact and electrically connected to an external electronic device.

Due to severe competition in the electronic instrument industry, there is an increasing demand for providing high-performance semiconductor chips at low cost. In order to meet the demand, recent studies have been focused on a cutting process and a cutting apparatus which are capable of reducing manufacturing cost and enhancing reliability.

SUMMARY

Embodiments of the inventive concept provide a wafer dicing blade that includes a cutting part with a protrusion, the protrusion having a uniform region with a substantially uniform width, and a support covering at least one sidewall of the cutting part, the protrusion of the cutting part extending beyond an edge of the support.

The protrusion of the cutting part may be configured to cut a wafer.

The cutting part may have a ring shape.

The cutting part may include a diamond-containing material.

The width of the uniform region of the protrusion may be about 1 micrometer to about 70 micrometers.

The support may include a material exhibiting a lower hardness than a material of a wafer to be cut by the cutting part.

The material of the support may include nickel.

A portion of the cutting part other than the protrusion may be configured as a seed layer for the support.

The protrusion may be integral with the cutting part, the protrusion and the cutting part extending in a same direction.

All of the protrusion may be beyond the edge of the support.

The protrusion may be shorter than the support, lengths of the protrusion and support being measured along a same direction.

Embodiments of the inventive concept also provide a wafer dicing blade that includes a cutting part having a substantially uniform width, and a support at least partially surrounding the cutting part, the support extending to a predetermined length along a longitudinal direction of the cutting part, and a portion of the cutting part extending beyond an edge of the support along the longitudinal direction of the cutting part and being configured to cut a wafer.

A length of the portion of the cutting part extending beyond the support may be shorter than the support, and the edge of the support being spaced apart from the wafer during an entire cutting process.

Embodiments of the inventive concept also provide a wafer dicing apparatus that includes a base configured to support a wafer, a rotatable frame over the base, and a wafer dicing blade on the rotatable frame, the wafer dicing blade having a cutting part with a protrusion, the protrusion having a uniform region with a substantially uniform width, and a support covering at least one sidewall of the cutting part, the protrusion of the cutting part extending beyond an edge of the support.

The cutting part of the wafer dicing blade may include a diamond-containing material.

The width of the uniform region of the protrusion may be about 1 micrometer to about 70 micrometers.

The support of the wafer dicing blade may include a material exhibiting a lower hardness than a material of the wafer.

The material of the support may include nickel.

The wafer dicing apparatus may further include a length maintaining device including a recess region, a width of the recess region being larger than that of the uniform region of the protrusion and smaller than an entire width of the wafer dicing blade, the entire width of the wafer dicing blade being a sum of a width of the support and a width of the cutting part.

The length maintaining device may further include an etching unit configured to etch the support.

BRIEF DESCRIPTION OF THE DRAWINGS

The above and other features and advantages will become more apparent to those of ordinary skill in the art by describing in detail exemplary embodiments with reference to the attached drawings, in which.

DETAILED DESCRIPTION

Figure 1A:
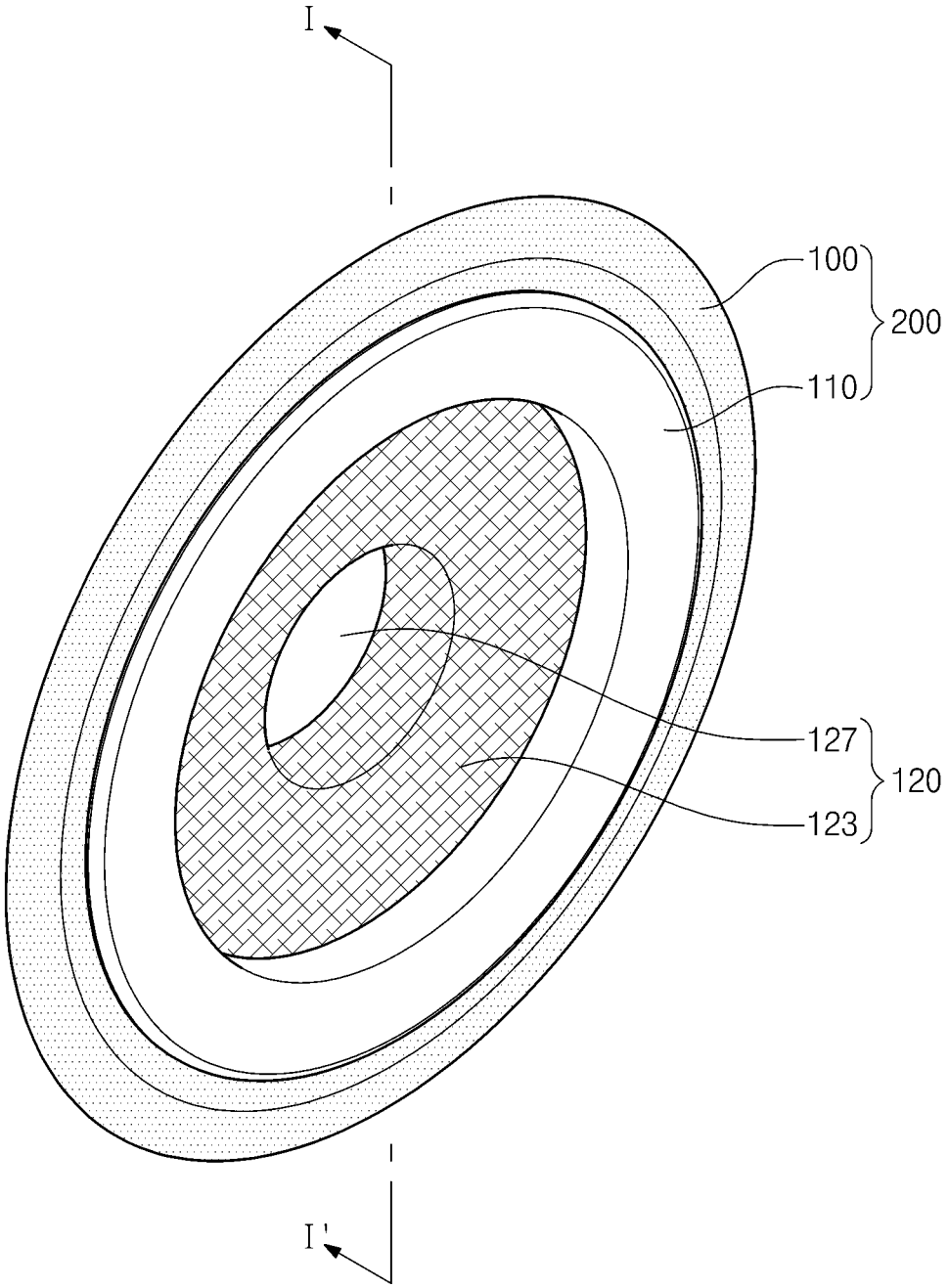
FIG. 1A illustrates a perspective view of a wafer dicing blade according to one embodiment of the inventive concept.

The advantages and features of the inventive concept and methods of achieving them will be apparent from the following exemplary embodiments that will be described in more detail with reference to the accompanying drawings. It should be noted, however, that the inventive concept is not limited to the following exemplary embodiments, and may be implemented in various forms. Accordingly, the exemplary embodiments are provided only to disclose the inventive concept and let those skilled in the art know the category of the inventive concept.

The terms used in the present specification are used to describe a particular embodiment and are not used to limit the present invention. As in the present specification, a singular form may include a plural form unless the singular form definitely indicated otherwise in the context. Also, in the present specification, the terms "comprise" and/or "comprising" specify existence of shapes, numbers, steps, operations, members, elements, and/or groups thereof, which are referred to, and do not exclude existence or addition of one or more different shapes, numbers, operations, members, elements, and/or groups thereof. In the specification, it will be understood that when an element is referred to as being "on" another layer or substrate, it can be directly on the other element, or intervening elements may also be present. In the drawings, thicknesses of elements are exaggerated for clarity of illustration.

Exemplary embodiments of the invention will be described below with reference to cross-sectional views, which are exemplary drawings of the invention. The exemplary drawings may be modified by manufacturing techniques and/or tolerances. Accordingly, the exemplary embodiments of the invention are not limited to specific configurations shown in the drawings, and include modifications based on the method of manufacturing the semiconductor device. For example, an etched region shown at a right angle may be formed in a rounded shape or formed to have a predetermined curvature. Therefore, regions shown in the drawings have schematic characteristics. In addition, the shapes of the regions shown in the drawings exemplify specific shapes of regions in an element, and do not limit the invention. Though terms like a first, a second, and a third are used to describe various elements in various embodiments of the inventive concept, the elements are not limited to these terms. These terms are used only to tell one element from another element. An embodiment described and exemplified herein includes a complementary embodiment thereof The terms used in the specification are for the purpose of describing particular embodiments only and are not intended to be limiting of the invention. As used in the specification, the singular forms "a", "an" and "the" are intended to include the plural forms as well, unless the context clearly indicates otherwise. It will be further understood that the terms "comprises" and/or "comprising", when used in the specification, specify the presence of stated features, integers, steps, operations, elements, and/or components, but do not preclude the presence or addition of one or more other features, integers, steps, operations, elements, components, and/or groups thereof Also, though terms like a first, a second, and a third are used to describe various regions and layers in various embodiments of the inventive concept, the regions and the layers are not limited to these terms. These terms are used only to tell one region or layer from another region or layer. Therefore, a layer referred to as a first layer in one embodiment can be referred to as a second layer in another embodiment. An embodiment described and exemplified herein includes a complementary embodiment thereof. Like reference numerals refer to like elements throughout.

Figure 2A:
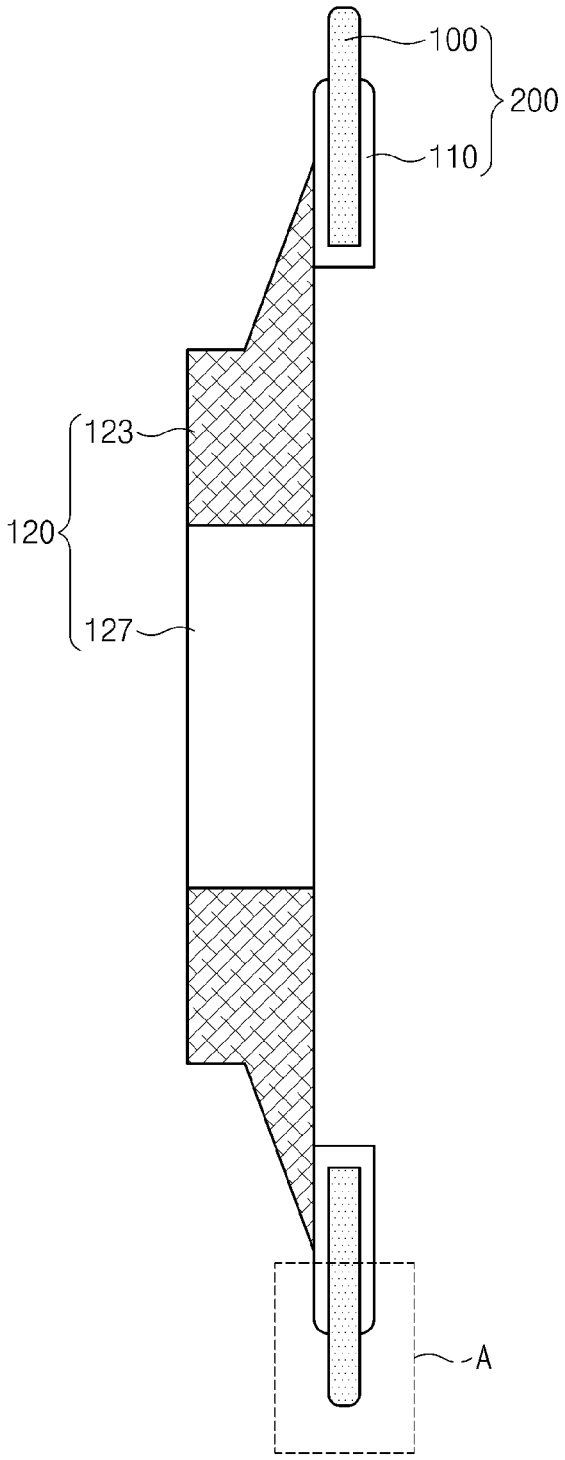
FIG. 2A illustrates a cross-sectional view along line I-I' of FIG. 1A.

FIG. 1A is a perspective view of a wafer dicing blade 200 according to one embodiment of the inventive concept, and FIG. 2A is a cross-sectional view taken along line I-I' in FIG. 1A.

Referring to FIGS. 1A and 2A, the wafer dicing blade 200 may include a cutting part 100 and a support 110 covering both sidewalls of the cutting part 100. That is, the support 110 may partially overlap two opposite sidewalls of the cutting part 100, as will be described in more detail below.

As illustrated in FIG. 1A, the cutting part 100 may have a ring shape. In detail, as illustrated in FIG. 2A, the cutting part 100 may have first and second sidewalls 100*a* and 100*b* opposite each other, an inner surface defining an inner circle, and an outer surface defining an outer circle. The cutting part 100 may include grit and a bond material. For example, the grit may include diamond particles, and the bond material may include at least one of a resin bond material, a vitrified bond material, and/or a metal bond material. Examples of the metal bond material may include copper (Cu), tin (Sn), and/or nickel (Ni). Examples of the resin bond material may include a thermosetting resin. For example, the cutting part 100 may be formed by combining the grit and the bond material at a high temperature and a high pressure. In another example, the cutting part 100 may be formed by means of an electroplating process.

Further, the cutting part 100 may be provided with porosity or chip pocket. In the case that the bond material contains a resin bond material or a vitrified bond material, the cutting part 100 may be provided with the porosity. In the case that the bond material contains a metal, the cutting part 100 may be provided with the chip pocket. The porosity or the chip pocket may make it possible to exhaust contaminants, e.g., swarf or dust, generated during wafer cutting. Moreover, the porosity or the chip pocket may make it possible to reduce heat produced by friction with a wafer during the wafer cutting.

For example, as illustrated in FIG. 2A, the support 110 may be disposed to surround both sidewalls, i.e., first and second sidewalls 100*a* and 100*b*, of the cutting part 100 and the inner surface of the cutting part 100. That is, the support 110 may extend to completely overlap the inner surface and partially overlap the first and second sidewalls 100*a* and 100*b*. Therefore, the support 110 may be a structure, e.g., having a U-shaped configuration, where both the sidewalls of the cutting part 100 and the inner surface of the cutting part 100 are connected to each other. In another example (not shown), the support 110 may be disposed only on both of the sidewalls of the cutting part 100 without overlapping the inner surface, i.e., the support 110 may include two portions completely separated from each other and positioned only on respective sidewalls of the cutting part 100.

The wafer dicing blade 200 including the support 110 and the cutting part 100 may be mounted on a rotatable frame 120. The rotatable frame 120 may include a hub 123 fixing the support 110 and the cutting part 100 and a fixed disk 127 on which the hub 123 is mounted. The hub 123 may have a ring shape. For example, an outer diameter of the hub 123 may be smaller than an outer diameter of the cutting part 100, while the outer diameter of the hub 123 may be greater than an inner diameter of the cutting part 100. The hub 123 may be directly connected with the support 110 to fix the wafer dicing blade 200 including the support 110. The hub 123 may include a metallic material, e.g., aluminum. The fixed disk 127 may have a center hole into which a rotating shaft is inserted. The fixed disk 127 may include a metallic material. The wafer dicing blade 200 connected to the hub 123 may be rotated using the rotating shaft mounted on the fixed disk 127. A plurality of semiconductor chips may be separated by cutting a wafer along scribe lanes due to high-speed rotation of the wafer dicing blade 200. According to one embodiment, the hub 123 may be omitted and the fixed disk 127 may be directly connected to the wafer dicing blade 200 including the support 110 to fix the wafer dicing blade 200.

Figure 2B:
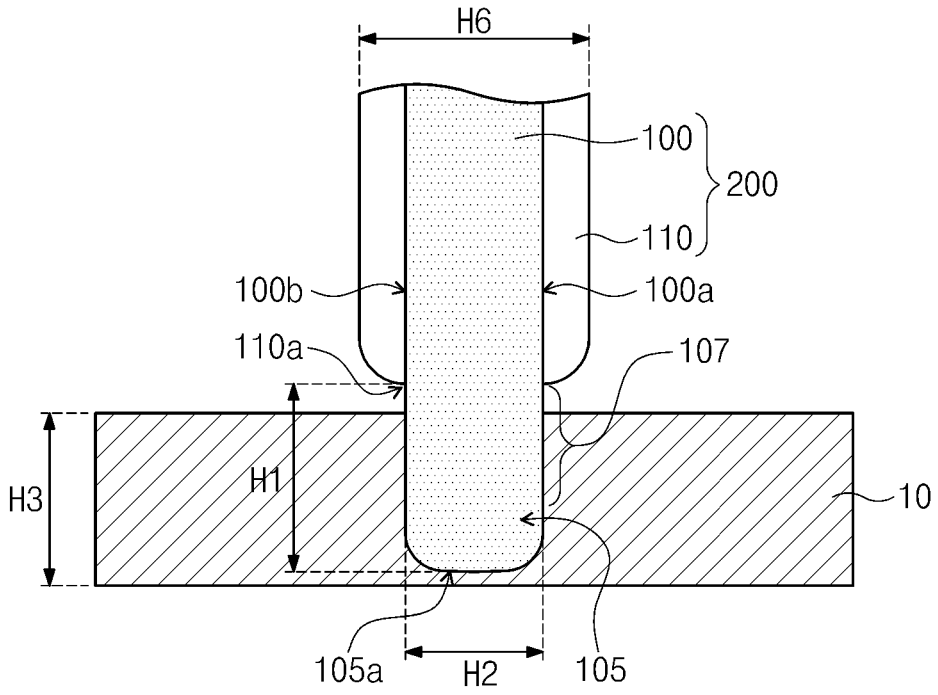
FIG. 2B illustrates an enlarged cross-sectional view of a region "A" in FIG. 2A.

FIG. 2B is an enlarged cross-sectional view of a region "A" shown in FIG. 2A.

Referring to FIG. 2B, the support 110 may be disposed to only partly cover both sidewalls of the cutting part 100. In other words, the cutting part 100 may include a protrusion 105 extending beyond an edge 110*a* of the support 110, i.e., the support 110 may not cover or overlap the protrusion 105 of the cutting part 100. That is, the protrusion 105 may be a portion of an uncovered cutting part 100.

The protrusion 105 may include a region 107 having a substantially uniform width $H_2$. The region 107 may be adjacent to the support 110, e.g., the region 107 may extend between the edge 110*a* of the support 110 and an edge 105*a* of the protrusion 105. The width $H_2$ of the region 107 may be a distance between both side surfaces of the region 107. The width $H_2$ of the region 107 may range from about 1 micrometer to about 70 micrometers. For example, the edge 105*a* of the protrusion 105 may be rounded. In another example, the protrusion 105 may have a substantially uniform width throughout. A length $H_1$ of the protrusion 105 may be a length the protrusion 105 extends beyond the edge 110*a* of the support 110, i.e., the length $H_1$ of the protrusion 105 may be a distance extending from the edge 110*a* of the support 110 to the edge 105*a* of the protrusion. When the wafer dicing blade 200 cuts a wafer 10, the wafer 10 may be cut by the protrusion 105 and the support 110 may not be directly used to cut the wafer 10. That is, the wafer 10 may be cut only by the protrusion 105, while the support 110 may be spaced apart from the wafer 10. For example, as shown in FIG. 2B, the length $H_1$ of the protrusion 105 may be smaller than a thickness $H_3$ of the wafer 10, so the wafer 10 may be, e.g., only, partly cut by the wafer dicing blade 200. The partly-cut wafer 10 may be completely cut by means of a breaking process. In another example, the length $H_1$ of the protrusion 105 may be equal to or greater than the thickness $H_3$ of the wafer 10, so the wafer 10 may be completely cut by the wafer dicing blade 200.

The support 110 may be formed by an electroplating process. For example, the support 110 may be formed by electroplating the cutting part 100, while the protrusion 105 of the cutting part 100 is not exposed to an electroplating solution for electroplating. The support 110 may include a material having a lower hardness than the wafer 10. For example, the wafer 10 may be made of a semiconductor material, e.g., silicon, germanium, etc., and the support 110 may be made of, e.g., nickel. Since the support 110 is made of a material having a lower hardness than the wafer 10, the support 110 may be easily abraded when the wafer 10 is in contact with the support 110. Thus, the support 110 is substantially incapable of cutting the wafer 10, thereby preventing a cut portion of the wafer 10 from increasing in width.

Figure 1B:
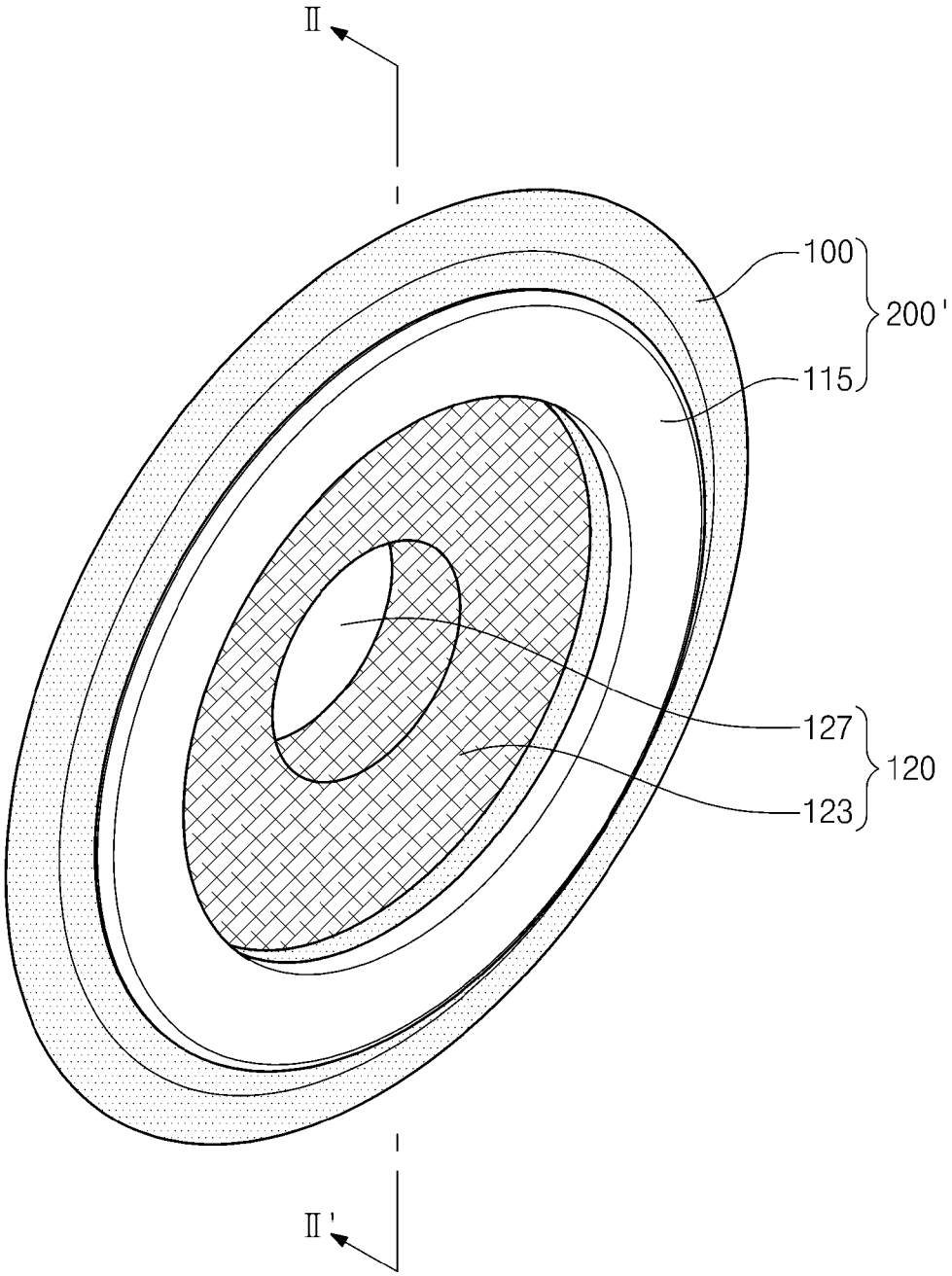
FIG. 1B illustrates a perspective view of a wafer dicing blade according to another embodiment of the inventive concept.
Figure 3A:
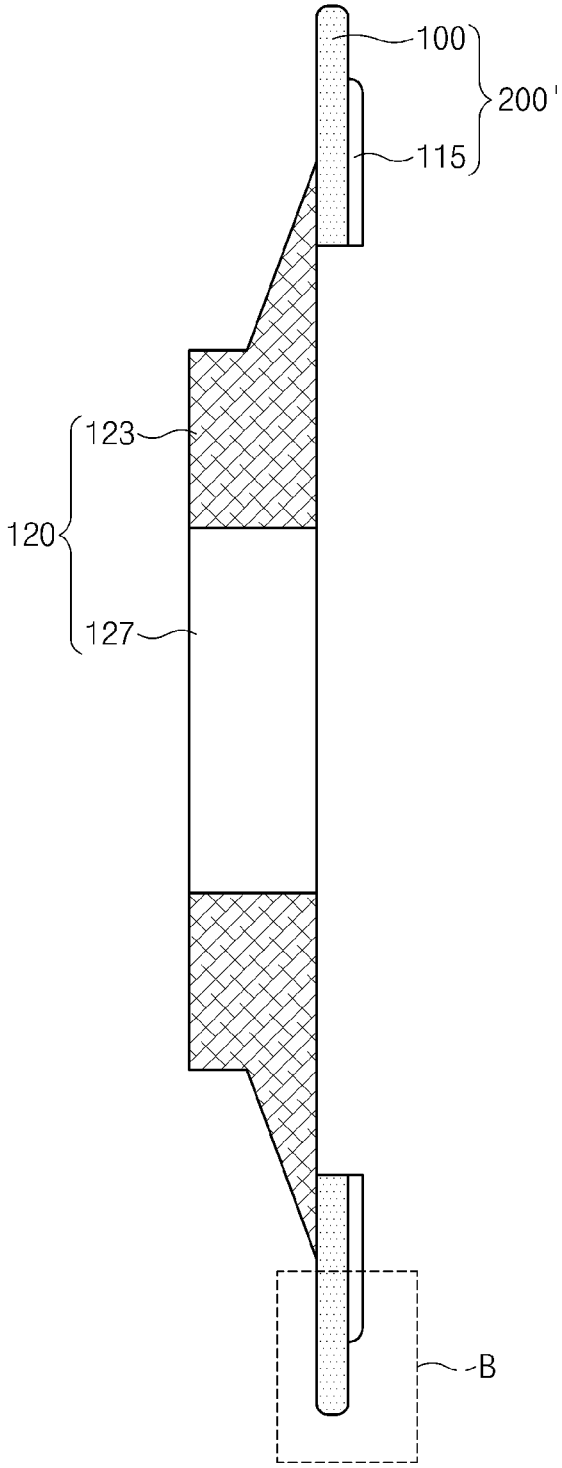
FIG. 3A illustrates a cross-sectional view along line II-II' of FIG. 1B.

FIG. 1B is a perspective view of a wafer dicing blade 200' according to another embodiment of the inventive concept, and FIG. 3A is a cross-sectional view taken along line II-II' in FIG. 1B.

Referring to FIGS. 1B and 3A, the wafer dicing blade 200' may include the cutting part 100 and a support 115 covering, e.g., only, one sidewall of the cutting part 100. The cutting part 100 may have a ring shape. Therefore, the cutting part 100 may have both sidewalls, the inner surface defining the inner circle, and the outer surface defining the outer circle. The cutting part 100 may include grit and a bond material. The grid may contain, e.g., diamond particles, and the bond material may contain, e.g., at least one of a resin bond material, a vitrified bond material, and/or a metal bond material. Examples of the metal may include copper (Cu), tin (Sn), and/or nickel (Ni). Examples of the resin bond material may be a thermosetting resin. For example, the cutting part 100 may be formed by combining the grit and the bond material at a high temperature and a high pressure. In another example, the cutting part 100 may be formed by means of an electroplating process.

The cutting part 100 may be provided with porosity or chip pocket. In the case that the bond material contains a resin bond material or a vitrified bond material, the cutting part 100 may be provided with the porosity. In the case that the bond material contains a metal, the cutting part 100 may be provided with the chip pocket. The porosity or the chip pocket may make it possible to exhaust contaminants, e.g., swarf or dust, generated during wafer cutting. Moreover, the porosity or the chip pocket may make it possible to reduce heat produced by friction with a wafer during the wafer cutting.

The support 115 may be disposed to cover only one sidewall, e.g., only the first sidewall 100*a*, of the cutting part 100. Hence, the other sidewall of the cutting part 100, e.g., the second sidewall 100*b*, the inner surface of the cutting part 100, and the outer surface of the cutting part 100 may not be covered with the support 115.

The wafer dicing blade 200' including the support 115 and the cutting part 100 may be mounted on the rotatable frame 120. Similar to the foregoing embodiment, the rotatable frame 120 may include the hub 123 and the fixed disk 127. For example, an outer diameter of the hub 123 may be smaller than an outer diameter of the cutting part 100, while the outer diameter of the hub 123 may be greater than an inner diameter of the cutting part 100. The hub 123 may be directly connected to one sidewall of the cutting part 100 to fix the wafer dicing blade 200'. The one sidewall of the cutting part 100 connected to the hub 123 may be a surface opposite to the sidewall of the cutting part 100 where the support 115 is disposed, e.g., the hub 123 may be directly connected to the second sidewall 100*b* of the cutting part 100.

The wafer dicing blade 200' connected to the hub 123 may be rotated using the rotating shaft mounted on the fixed disk 127. A plurality of semiconductor chips may be separated by cutting a wafer along scribe lanes due to high-speed rotation of the wafer dicing blade 200'. According to one embodiment, the hub 123 may be omitted and the fixed disk 127 may be directly connected to the wafer dicing blade 200' including the support 115 to fix the wafer dicing blade 200'.

Figure 3B:
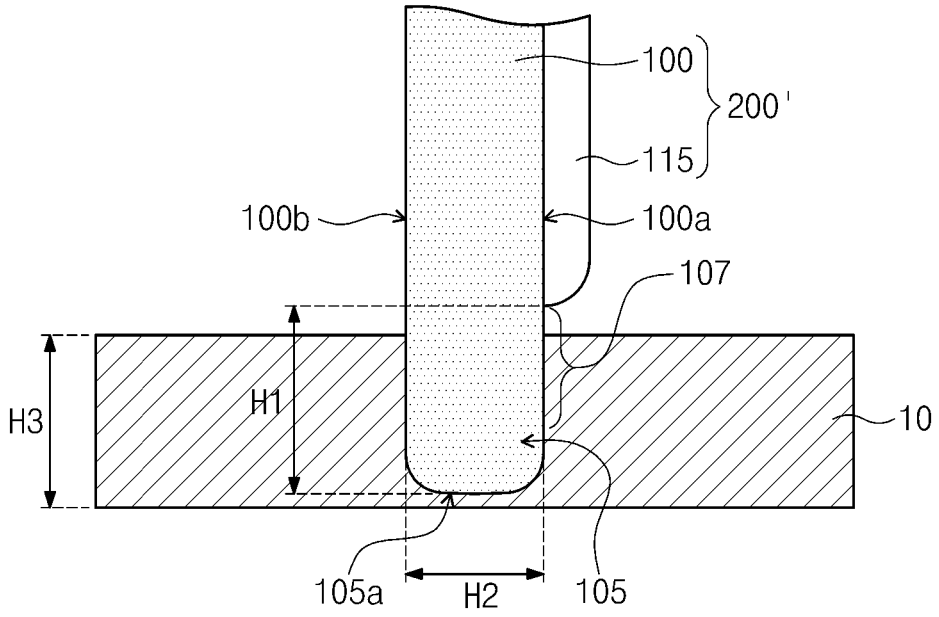
FIG. 3B illustrates an enlarged cross-sectional view of a region "B" in FIG. 3A.

FIG. 3B is an enlarged cross-sectional view of a region "B" shown in FIG. 3A.

Referring to FIG. 3B, the support 115 may be disposed to cover a portion of one sidewall of the cutting part 105. The cutting part 100 may include the protrusion 105 that is more protrusive than one end of the support 115. The protrusion 105 may include the region 107 having a substantially uniform width $H_2$. The region 107 may be adjacent to the support 115. The width $H_2$ of the region 107 may be a distance between both side surfaces of the region 107. The width $H_2$ of the region 107 may range from about 1 micrometer to about 70 micrometers. The edge of the protrusion 105 may be rounded. According to one embodiment, the protrusion 105 may have a substantially uniform width throughout. A length $H_1$ of the protrusion 105 may be a protruding length of the protrusion 105 from the edge of the support 115. That is, the length $H_1$ of the protrusion 105 may be a height from the edge of the support 115 to the edge of the protrusion 105. When the wafer dicing blade 200' cuts the wafer 10, the wafer 10 may be cut by the protrusion 105, so the support 115 may not be directly used to cut the wafer 10. As shown in FIG. 3B, the length $H_1$ of the protrusion 105 may have a smaller value than the width $H_3$ of the wafer 10 cut by the wafer dicing blade 200'. In this case, the wafer 10 may be partly cut by the wafer dicing blade 200'. The partly-cut wafer 10 may be completely cut by means of a breaking process. Alternatively, the length $H_1$ of the protrusion 105 may have the same value as or a greater value than the height $H_3$ of the wafer 10 cut by the wafer dicing blade 200'. In this case, the wafer 10 may be completely cut by the wafer dicing blade 200'.

The support 115 may be formed by an electroplating process. For example, the support 115 may be formed by electroplating the cutting part 100 while the protrusion 105 of the cutting part 100 and the other surface of the cutting part 100 are not exposed to an electroplating solution for electroplating. Similar to the foregoing embodiment, the support 115 may contain a material having a lower hardness than the wafer 10. For example, the wafer 10 may be made of a semiconductor material (e.g., silicon, germanium, etc.) and the support 115 may contain nickel. Since the support 110 is made of a material having a lower hardness than the wafer 10, the support 110 may be easily abraded when the wafer 10 is in contact with the support 115. Thus, the support 115 is substantially incapable of cutting the wafer 10, thereby preventing a cut portion of the wafer 10 from increasing in width.

While the support 110 described with reference to FIGS. 1A and 2A-2B is disposed on both side surfaces of the cutting part 100, the support 115 described with reference to FIGS. 1B and 3A-3B is disposed only on one side surface of the cutting part 100. Therefore, an overall thickness of the support 115 may be smaller than that of the support 110. In other words, an overall width $H_6$ of the wafer dicing blade 200 (FIG. 2B) may be larger than that of the wafer dicing blade 200', as the support 115 is formed on only one surface of the cutting part 110.

According to the above-described embodiments, the support 110 or 115 may be disposed on the sidewall of the cutting part 100, and the cutting part 100 may include the protrusion 105 that is a portion protruding away from one end of the support 110 or 115 toward the wafer 10. When the wafer 10 is cut, the support 110 or 115 serves to support the cutting part 100 from pressure applied to the cutting part 100, and only the protrusion 105 may contact and cut the wafer 10. Thus, the width of the cutting part 100 may be reduced without reducing the length of the cutting part 100, i.e., a distance from an inner surface to an outer surface of the cutting part 100. As a result, use period of the cutting part 100 may be extended. Moreover, as the support 110 or 115 may not contact the wafer 10 when the wafer 10 is cut, i.e., only the protrusion 105 of the cutting part 100 may be used to cut the wafer 10, scribe lanes formed among a plurality of semiconductor chips to cut the wafer 10 may be decreased in width due to the decreased width of the cutting part 100, i.e., width $H_2$ of the protrusion 105. As a result, more semiconductor chips may be formed on a single wafer 10, thereby reducing manufacturing costs. Furthermore, as the width of the cutting part 100 decreases, a warpage phenomenon of the cutting part 100 resulting from pressure applied thereto may be minimized when the wafer 10 is cut. Thus, since defects caused by the warpage phenomenon of the cutting part 100 may be reduced, a wafer dicing blade of high reliability may be realized and a process margin of a wafer cutting process may be improved.

Figure 4:
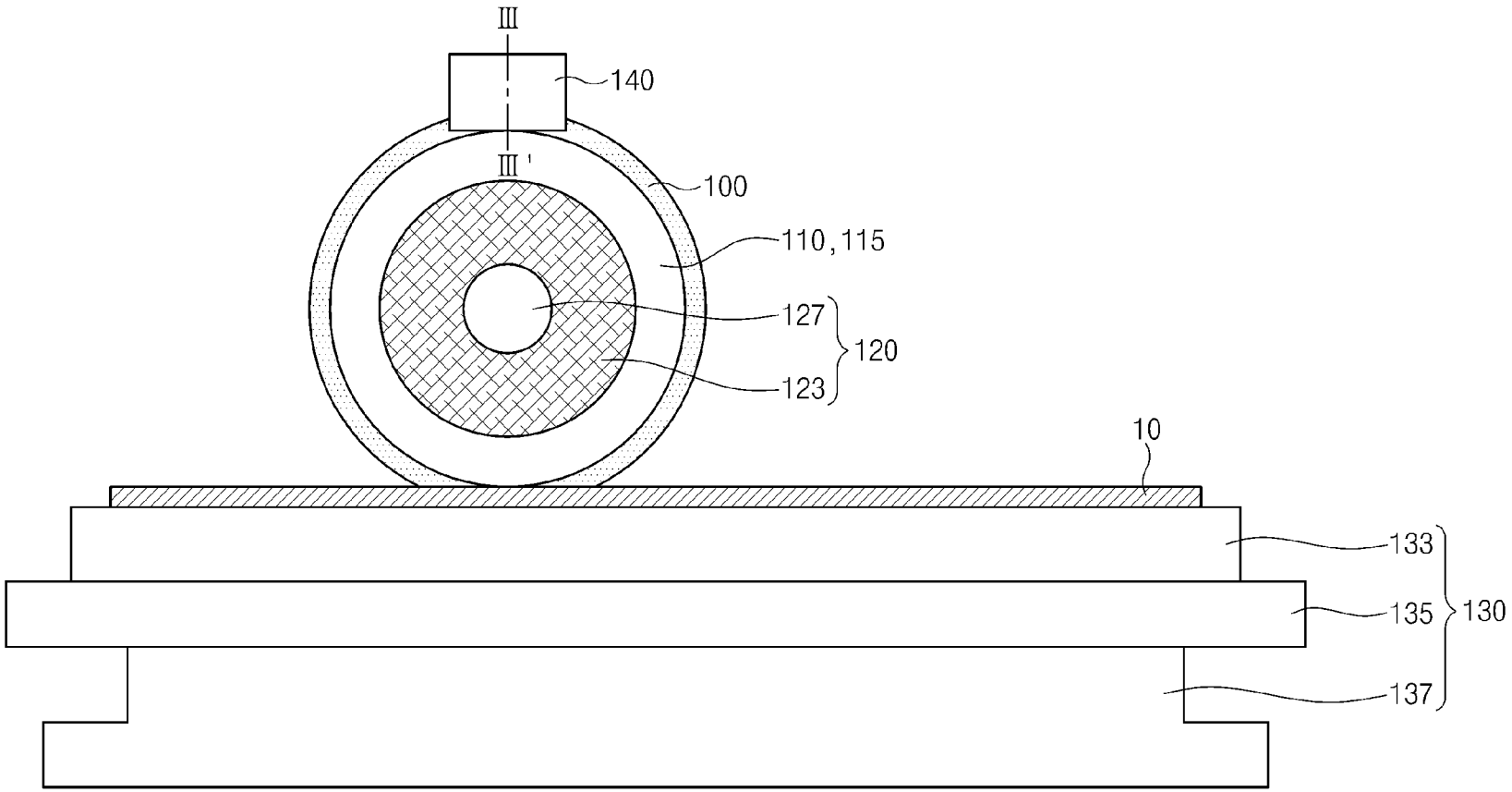
FIG. 4 illustrates a side view of a wafer dicing apparatus including a wafer dicing blade according to embodiments of the inventive concept.
Figure 5:
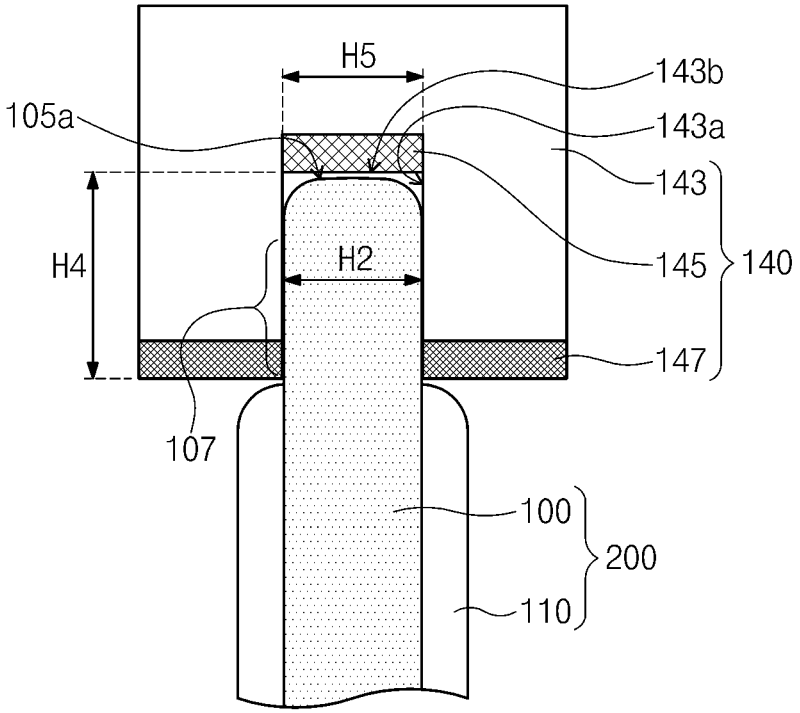
FIG. 5 illustrates a cross-sectional view taken along line III-III' in FIG. 4.

FIG. 4 is a side view of a wafer dicing apparatus including a wafer dicing blade according to embodiments of the inventive concept. FIG. 5 is a cross-sectional view taken along line III-III' in FIG. 4.

Referring to FIGS. 4-5, a wafer dicing apparatus according to one embodiment of the inventive concept may include a base 130 on which the wafer 10 is loaded. The base 130 may include a dicing adhesive tape 133, a cutting table 135, and a chuck 137. The chuck 137 may be formed, e.g., of porous ceramic. The chuck 137 may align the wafer 10 during a wafer cutting process. The cutting table 135 may be disposed on the chuck 137. The dicing adhesive tape 133 may be disposed on the cutting table 135. The dicing adhesive tape 133 may be made of a material having substantially no electrical conductivity. For example, the dicing adhesive tape 133 may be a porous material. The dicing adhesive tape 133 may fix the aligned wafer 10 during the wafer cutting process.

The wafer dicing apparatus may further include a rotatable frame 120 disposed over the base 130. As described previously with reference to FIGS. 1A-3B, the rotatable frame 120 may include the hub 123 and the fixed disk 127.

The wafer dicing apparatus may further include the wafer dicing blade 200 or 200' mounted on the rotatable frame 120. As described previously with reference to FIGS. 1A-3B, the wafer dicing blade 200 or 200' may include the cutting part 100 and the support 110 or 115.

The support 110 may be formed to surround both sidewalls of the cutting part 100 and an inner surface of the cutting part 100, or the support 110 may not be formed on the inner surface of the cutting part 100, i.e., the support 110 may be disposed only on both the sidewalls of the cutting part 100 to be separated on respective sidewalls. The support 115 may be formed to cover a portion of one sidewall of the cutting part 100, so another sidewall, an outer surface, and an inner surface of the cutting part 100 may not be covered with the support 115.

The cutting part 100 may include the protrusion 105 that is more protrusive than one end of the support 110 or 115. The protrusion 105 may be a portion of the cutting part 110 whose both sidewalls are not covered with the support 110 or 115. The protrusion 105 may include the region 107 having a substantially uniform width $H_2$. The region 107 may be adjacent to the support 110 or 115. The width $H_2$ of the region 107 may be a distance between both side surfaces of the region 107. The width $H_2$ of the region 107 may range from about 1 micrometer to about 70 micrometers. The edge of the protrusion 105 may be rounded. According to one embodiment, the protrusion 105 may have a substantially uniform width throughout. The length $H_1$ of the protrusion 105 may be a protruding length of the protrusion 105 from the edge of the support 110 or 115. That is, the length $H_1$ of the protrusion 105 may be a height from the edge of the support 110 to the edge of the protrusion 105. When the wafer dicing blade 200 cuts the wafer 10, the wafer 10 may be cut by the protrusion 105 and the support 110 may not directly participate in cutting of the wafer 10. As shown in FIG. 2B, the length $H_1$ of the protrusion 105 may have a smaller value than the width $H_3$ of the wafer 10 cut by the wafer dicing blade 200. In this case, the wafer 10 may be partly cut by the wafer dicing blade 200. The partly-cut wafer 10 may be completely cut by means of a breaking process. Alternatively, the length $H_1$ of the protrusion 105 may have the same value as or a greater value than the height $H_3$ of the wafer 10 cut by the wafer dicing blade 200. In this case, the wafer 10 may be completely cut by the wafer dicing blade 200.

The wafer dicing apparatus may further include a length maintaining device 140, as illustrated in FIGS. 4-5. Referring to FIG. 5, the length maintaining device 140 may include a body 143, a sensor 145, and an etching unit 147.

The body 143 may be disposed to engage with the protrusion 105 of the cutting part 100. The body 143 may include a recessed region 143*a* having a depth $H_4$ and a width $H_5$. The width $H_5$ of the recessed region 143*a* may be greater than the width $H_2$ of the region 107. The width $H_5$ of the recessed region 143*a* may be smaller than a total width H6 of the wafer dicing blade 200 (FIG. 2B), i.e., a sum of the width of the cutting part 110, e.g., width H2, and a width of the support 110 or 115.

The sensor 145 may be disposed on a surface of the recessed region 143*a* adjacent to the edge 105*a* of the protrusion 105 of the cutting part 100, and may monitor a predetermined distance between a surface 143*b* of the sensor 145, and the edge 105*a* of the protrusion 105. When the protrusion 105 is abraded, e.g., due to repeated use of the wafer dicing blade 200, and the predetermined distance between the surface 143*b* and the edge 105*a* of the protrusion 105 increases, i.e., the length $H_1$ decreases, length maintaining device 140 may move toward the edge 105*a* of the protrusion 105 in accordance with the decreased length $H_1$ of the protrusion 105. In another words, the length maintaining device 140 may maintain a constant distance between the edge 105*a* of the protrusion 105 and the sensor 145, i.e., surface 143*b*.

The etching unit 147 may be disposed at the body 143 adjacent to the support 110. As the sensor 145 senses that the predetermined distance between the surface 143*b* and the edge 105*a* of the protrusion 105 increases, e.g., due to abrasion of the edge 105*a* of the protrusion 105, and the length maintaining device 140 moves toward the edge 105*a* of the protrusion 105 to maintain a constant distance between the edge 105*a* of the protrusion 105 and the sensor 145, the etching unit 147 may move towards and contacts the support 110, thereby etching the support 110. Thus, the length maintaining device 140 may maintain a substantially uniform length $H_1$ of the protrusion 105 by etching a portion of the support 110 when the protrusion 105 is abraded to decrease its length $H_1$.

Figure 6:
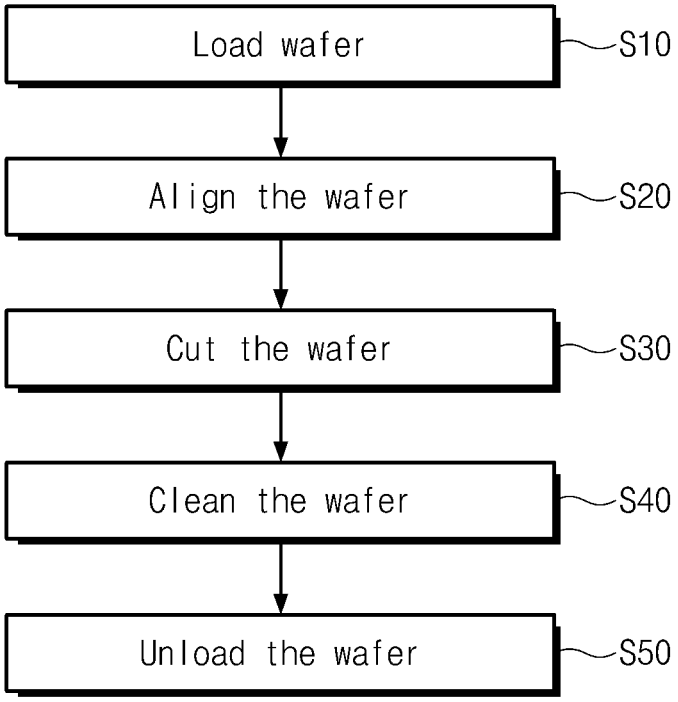
FIG. 6 illustrates a flowchart of a wafer dicing process using a wafer dicing apparatus including a wafer dicing blade according to embodiments of the inventive concept.

FIG. 6 is a flowchart illustrating a wafer dicing process using the wafer dicing apparatus with the wafer dicing blade 200.

Referring to FIGS. 5 and 6, the wafer 10 may be loaded on the base 130 (operation S10). The loaded wafer 10 may be aligned by the chuck 137 (operation S20). Due to the alignment of the wafer 10, the wafer dicing blade 200 may cut the wafer 10 along scribe lanes formed on the wafer 10. The aligned wafer 10 may be fixed by the dicing adhesive tape 133 included in the base 130. Thus, the dicing adhesive tape 133 may prevent the wafer 10 from moving during a wafer cutting step, thereby minimizing or substantially preventing cutting of regions outside the scribe lanes.

After alignment of the wafer 10, the wafer 10 may be divided into a plurality of chips by means of a wafer cutting process using the wafer dicing blade 200 (operation S30). The wafer 10 may be cut by rotating the wafer dicing blade 200 at high speed. For example, the wafer 10 may be first cut to, e.g., half, the thickness $H_3$ thereof by using a typical wafer dicing blade, followed by completing the cutting of the wafer 10 by using the wafer dicing blade 200 according to embodiments of the inventive concept. In another example, the first step may be omitted, i.e., an entire thickness $H_3$ of the wafer 10 may be cut by the wafer dicing blade 200. In yet another example, a portion of the wafer 10 may be first cut by using the wafer dicing blade 200, followed by a breaking process to complete separation of the wafer 10 into a plurality of chips.

The cut wafer 10 may be cleaned to remove swarf and dust generated during the wafer cutting (operation 40). The cleaning step may be conducted by spraying deionized water (DI water) or the like onto the wafer 10. Thereafter, the cut wafer 10 may be unloaded from the base 130 (operation S50).

According to embodiments of the inventive concept, a support may be disposed on at least one side surface of a cutting part, such that an edge of the cutting part, i.e., a protrusion, extends beyond an edge of the support. A width of the cutting part may be reduced due to the support. That is, although the width of the cutting part is reduced, a warpage phenomenon of the cutting part may be minimized due to the support. Since the width of the cutting part is reduced, widths of scribe lanes formed on the wafer may also be reduced. Thus, more semiconductor chips may be formed on a single wafer to decrease manufacturing costs of the semiconductor chips. Moreover, the warpage phenomenon of the cutting part is minimized to realize a wafer dicing blade of high reliability and improve a process margin of a wafer cutting process. In addition, since the cutting part includes the protrusion, the support may not participate in cutting the wafer, i.e., may not contact the wafer during cutting, thereby use period of the cutting part may be extended.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A wafer dicing blade, comprising:

a cutting part including a main part and a protrusion extending from the main part, the protrusion having a same width as the main part and a uniform region with a substantially uniform width; and a support covering at least one sidewall of the main part of the cutting part, the protrusion of the cutting part extending beyond an edge of the support, wherein the support includes first and second portions covering two opposite sidewalls of the cutting part, the first and second portions of the support being symmetrical with respect to the cutting part and integral with each other.

2. The wafer dicing blade as claimed in claim 1, wherein the protrusion of the cutting part is configured to cut a wafer.

3. The wafer dicing blade as claimed in claim 1, wherein the entire cutting part has a uniform width and a ring shape.

4. The wafer dicing blade as claimed in claim 1, wherein the cutting part includes a diamond-containing material.

5. The wafer dicing blade as claimed in claim 4, wherein the width of the uniform region of the protrusion is about 1 micrometer to about 70 micrometers.

6. The wafer dicing blade as claimed in claim 1, wherein the support includes a material exhibiting a lower hardness than a material of a wafer to be cut by the cutting part.

7. The wafer dicing blade as claimed in claim 6, wherein the material of the support includes nickel.

8. The wafer dicing blade as claimed in claim 1, wherein the main part of the cutting part is configured as a seed layer for the support.

9. The wafer dicing blade as claimed in claim 1, wherein the entire protrusion is integral with the main part of the cutting part, the protrusion and the main part of the cutting part extending in a same direction.

10. The wafer dicing blade as claimed in claim 9, wherein all of the protrusion is beyond the edge of the support.

11. The wafer dicing blade as claimed in claim 10, wherein the protrusion is shorter than the support, lengths of the protrusion and support being measured along a same direction.

12. A wafer dicing blade, comprising:

a cutting part having a substantially uniform width; and a support at least partially surrounding the cutting part, the support extending to a predetermined length along a longitudinal direction of the cutting part, and a portion of the cutting part extending beyond an edge of the support along the longitudinal direction of the cutting part and being configured to cut a wafer, wherein the support includes first and second portions covering two opposite sidewalls of the cutting part, the first and second portions of the support being symmetrical with respect to the cutting part and integral with each other.

13. The wafer dicing blade as claimed in claim 12, wherein a length of the portion of the cutting part extending beyond the support is shorter than the support, and the edge of the support being spaced apart from the wafer during an entire cutting process.

14. A wafer dicing apparatus, comprising:

a base configured to support a wafer;

a rotatable frame over the base;

a wafer dicing blade on the rotatable frame, the wafer dicing blade including:

a cutting part with a protrusion, the protrusion having a uniform region with a substantially uniform width, and a support covering at least one sidewall of the cutting part, the protrusion of the cutting part extending beyond an edge of the support; and a length maintaining device including a recess region, a width of the recess region being larger than that of the uniform region of the protrusion and smaller than an entire width of the wafer dicing blade, the entire width of the wafer dicing blade being a sum of a width of the support and a width of the cutting part.

15. The wafer dicing apparatus as claimed in claim 14, wherein the cutting part of the wafer dicing blade includes a diamond-containing material.

16. The wafer dicing apparatus as claimed in claim 15, wherein the width of the uniform region of the protrusion is about 1 micrometer to about 70 micrometers.

17. The wafer dicing apparatus as claimed in claim 14, wherein the support of the wafer dicing blade includes a material exhibiting a lower hardness than a material of the wafer.

18. The wafer dicing apparatus as claimed in claim 17, wherein the material of the support includes nickel.

19. The wafer dicing apparatus as claimed in claim 14, wherein the length maintaining device further includes an etching unit configured to etch the support.

* * * * *